US007303275B2

(12) United States Patent
Katsuyama

(10) Patent No.: US 7,303,275 B2
(45) Date of Patent: Dec. 4, 2007

(54) INKJET RECORDING DEVICE

(75) Inventor: Goro Katsuyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 254 days.

(21) Appl. No.: 11/046,886

(22) Filed: Feb. 1, 2005

(65) Prior Publication Data

US 2005/0190251 A1 Sep. 1, 2005

(30) Foreign Application Priority Data

Feb. 10, 2004 (JP) ..... 2004-032974

(51) Int. Cl.

| | |
|---|---|
| ***B41J 2/01*** | (2006.01) |
| ***B41J 13/10*** | (2006.01) |
| ***B41J 3/60*** | (2006.01) |
| ***B65H 15/00*** | (2006.01) |

(52) U.S. Cl. ..... 347/104; 400/188; 400/642

(58) Field of Classification Search ..... None
See application file for complete search history.

(56) References Cited

U.S. PATENT DOCUMENTS

| | | | | |
|---|---|---|---|---|
| 4,970,528 | A | 11/1990 | Beaufort et al. | |
| 5,212,497 | A * | 5/1993 | Stanley et al. | 347/19 |
| 6,296,405 | B1 * | 10/2001 | Brewington et al. | 400/188 |
| 6,382,771 | B1 * | 5/2002 | Ikeda et al. | 347/55 |
| 6,848,850 | B2 * | 2/2005 | Matsuo et al. | 400/693 |
| 7,093,932 | B2 | 8/2006 | Inokuchi et al. | |
| 2001/0019349 | A1 | 9/2001 | Kawakami | |

FOREIGN PATENT DOCUMENTS

| | | | |
|---|---|---|---|
| EP | 1 332 885 A2 | | 8/2003 |
| JP | 05131696 A | * | 5/1993 |
| JP | 07323615 A | * | 12/1995 |
| JP | 08-108593 | | 4/1996 |
| JP | 10-53368 | | 2/1998 |
| JP | 2000-214650 | | 8/2000 |
| JP | 2002-247262 | | 8/2002 |
| JP | 2003-89249 | | 3/2003 |
| JP | 2003-182106 | | 7/2003 |
| JP | 2003-231317 | | 8/2003 |
| JP | 2003-326787 | | 11/2003 |
| JP | 2004-98618 | | 4/2004 |
| JP | 2004-106397 | | 4/2004 |
| JP | 2004-230880 | | 8/2004 |

* cited by examiner

*Primary Examiner*—Daniel J. Colilla
(74) *Attorney, Agent, or Firm*—Oblon, Spivak, McClelland, Maier & Neustadt, P.C.

(57) ABSTRACT

An inkjet recording device, includes a recording head configured to discharge a liquid drop of recording liquid in a horizontal direction or in a vertically lower direction than the horizontal direction; and a conveying part configured to convey a recording medium so that a recording surface faces the recording head when the recording medium passes a liquid drop discharge area of the recording head. The recording medium is discharged, after the recording medium is conveyed in a curved state so that the recording surface where the liquid drop discharged from the recording head is adhered faces in a vertically lower direction than the horizontal direction, by the conveying part. The conveying part includes a surface moving member configured to make a moving surface of the surface moving member come in contact with an external circumferential surface of a curved part of the recording medium so as to give a conveying force to the recording medium by a friction force.

14 Claims, 6 Drawing Sheets

INKJET RECORDING DEVICE

BACKGROUND OF THE INVENTION

1. Field of the Invention

The present invention relates to inkjet recording devices, and more specifically, to an inkjet recording device whereby a liquid drop of recording liquid such as ink is discharged from a recording head to a recording surface of a recording medium such as a recording paper so that an image is recorded.

An inkjet recording device such as an inkjet printer is frequently used for personal use more than an electronic picture type image forming device. Because of this, there is a demand for the device main body to be miniaturized and a necessary space be made narrow. It is effective to improve a device layout in order to correspond to such a demand. Hence, a device having various device layouts exists. For example, FIG. 1, FIG. 2 and others of the Japan Laid-Open Patent Application No. 2003-326787 disclose an inkjet printer having a device layout wherein a paper feeding tray is provided at a rear surface side of the device and image recording is performed on a recording paper (recording medium) while the recording paper fed from the paper feeding tray is conveyed to a front surface side. This device layout has been widely applied to an inkjet printer being in the market. In addition, FIG. 5, FIG. 6, FIG. 7 and others of the Japan Laid-Open Patent Application No. 2003-182106 disclose an inkjet printer wherein a paper feeding tray is provided at a lower part of a recording part having a recording head. In this inkjet recording device, a recording paper part just after being fed from the paper feeding tray is curved approximately 180 degrees to a moving direction and then is conveyed linearly toward a paper discharge tray. After that, an image is recorded at a position facing the recording paper part linearly conveyed, by the recording head.

However, in the above mentioned inkjet recording devices, the image is recorded on an upper surface of the discharged recording paper and the discharged recording paper is stacked from the bottom in order. Therefore, the line order of the discharged papers is opposite to the printing order. Because of this, when a document having plural pages is printed, since normally printing is performed in page order, the user has to reverse the line order of the discharged papers. Hence, there is a disadvantage in that this is inconvenient for the user.

This disadvantage can be solved, in the above mentioned inkjet recording devices, by positioning the recording head to the opposite side against the conveying path of the recording paper. However, under this layout, the ink is discharged from the recording head to an upper part in an upward vertical direction. Therefore, it is necessary to have a recording head whereby the ink is adhered to the recording paper at high precision with a strong discharging force for making the ink adhere to the recording paper against gravity. Hence, it is difficult to realize this.

An inventor of the present invention worked out a device layout wherein ink is discharged onto a fed recording paper from a horizontal direction or a vertically higher direction than the horizontal direction so that an image is recorded, then the recording paper is curved until the recording surface of the recording paper faces a lower part in the downward vertical direction, and then the recording paper is discharged. Under this device layout, since the line order of the discharged papers is the same as the printing order, the above-mentioned problem can be prevented. Furthermore, since the recording head by which the ink can be discharged in the vertically lower direction or discharged in the horizontal direction can be applied, it is easy to realize this.

However, the following problem was found by the inventor to realize the device layout according to further studies of the inventor.

That is, since normally a large friction force occurs between the curved recording paper part and a guide surface for curving the recording paper part, a conveying load is made large. Because of this, in a case where the above-mentioned device layout is applied, it is necessary to apply a stronger conveying force to the recording paper as compared with the layout whereby the recording paper is linearly conveyed. Furthermore, in order to obtain the stable conveyance of the recording paper, it is desirable to give a conveying force to the recording paper at least in the vicinity of the curved recording paper part. In addition, it is necessary to correspond to the demand for miniaturization of the device in order to realize this device layout, and therefore it is desirable to convey the recording paper in a state where the recording paper part just after the image is recorded is curved. Thus, in order to realize the above-mentioned device layout, it is required to give a strong conveying force to the recording paper part in a state where the ink is not dried completely. Furthermore, in a case where such a strong conveying force is given, a slight slip between a surface moving member such as a conveying roller for giving the conveying force and the recording paper may occur. Accordingly, if the strong force is given from the recording surface side in the state where the ink is not dried completely on the recording paper, the image is rubbed by the slip so that the image quality is degraded.

SUMMARY OF THE INVENTION

Accordingly, it is a general object of the present invention to provide a novel and useful ink jet recording device in which one or more of the problems described above are eliminated.

Another and more specific object of the present invention is to provide an inkjet recording device whereby it is possible to obtain a stable conveying of a paper without degradation of an image quality even if the above mentioned device layout that an inventor of the present invention made is applied.

The above objects of the present invention are achieved by an inkjet recording device, including:

a recording head configured to discharge a liquid drop of recording liquid in a horizontal direction or in a vertically lower direction than the horizontal direction; and a conveying part configured to convey a recording medium so that a recording surface faces the recording head when the recording medium passes a liquid drop discharge area of the recording head;

wherein the recording medium is discharged, after the recording medium is conveyed in a curved state so that the recording surface where the liquid drop discharged from the recording head is adhered faces in a vertically lower direction than the horizontal direction, i.e. in a downward direction, by the conveying part, and wherein the conveying part includes a surface moving member configured to make a moving surface of the surface moving member come in contact with an external circumferential surface of a curved part of the recording medium so as to give a conveying force to the recording medium by a friction force.

The above objects of the present invention are also achieved by an inkjet recording device, including:

a recording head configured to discharge a liquid drop of recording liquid in a horizontal direction or in a vertically lower direction than the horizontal direction; and means for conveying a recording medium so that a recording surface faces the recording head when the recording medium passes a liquid drop discharge area of the recording head;

wherein the recording medium is discharged, after the recording medium is conveyed in a curved state so that the recording surface where the liquid drop discharged from the recording head is adhered faces in a vertically lower direction than the horizontal direction, by the means for conveying, and wherein the means for conveying includes surface moving means for making its moving surface come in contact with an external circumferential surface of a curved part of the recording medium so as to give a conveying force to the recording medium by a friction force.

Thus, according to the present invention, the recording medium is discharged after being conveyed in a curved state so that the recording surface where the liquid drop discharged from the recording head is adhered faces the lower part in the downward vertical direction. Therefore, with the recording head configured to discharge the liquid drop of recording liquid in the horizontal direction or a vertically lower direction than the horizontal direction, it is possible to be consistent with an arranging order and a printing order of the recording medium where the image is recorded. Here, in a case where the recording medium is conveyed in the curved state, due to stiffness of the recording medium, a restoring force of the recording medium to the external circumferential surface side works at the curved part of the recording medium. As a result of this, a conveying load at the curved part of the recording medium is made large. Because of this, in the inkjet recording device of the present invention, the surface of the surface moving member is made to come in contact with the external circumferential surface of the curved part of the recording medium, so that the conveying force is given to the recording medium by a friction force working at the contact part. Under this structure, the restoring force increases the friction force between the surface of the surface moving member and the external circumferential surface of the curved part and improves the conveyance ability. That is to say, according to the inkjet recording device of the present invention, by using the restoring force which causes the increase of the conveying load, it is possible to improve the conveyance ability and obtain stable conveyance ability. The external circumferential surface of the curved part where the surface of the surface moving member comes in contact is the back surface opposite to the recording surface where the image is recorded. Accordingly, even if a slight slip is generated between the surface moving member and the surface of the recording medium, it is possible to prevent from rubbing and disarranging the image on the recording surface, and therefore it is possible to give a conveying force to the recording medium.

That is, according to the present invention, while the recording head configured to discharge the liquid drop of recording liquid in the horizontal direction or a vertically lower direction the horizontal direction, it is possible to be consistent with the arranging order and the printing order of the recording medium where the image is recorded. Hence, it is possible to easily realize the present invention. In addition, it is possible to obtain stable conveyance ability without degrading image quality.

Other objects, features, and advantages of the present invention will become more apparent from the following detailed description when read in conjunction with the accompanying drawings.

DETAILED DESCRIPTION OF THE PREFERED EMBODIMENTS

A description of the present invention and details of drawbacks of the related art are now given, with reference to FIG. 1 through FIG. 13, including embodiments of the present invention.

More specifically, in the following, one embodiment where the present invention is applied to an inkjet printer (hereinafter "printer") as one example of an ink jet recording device, is discussed.

Figure 2:
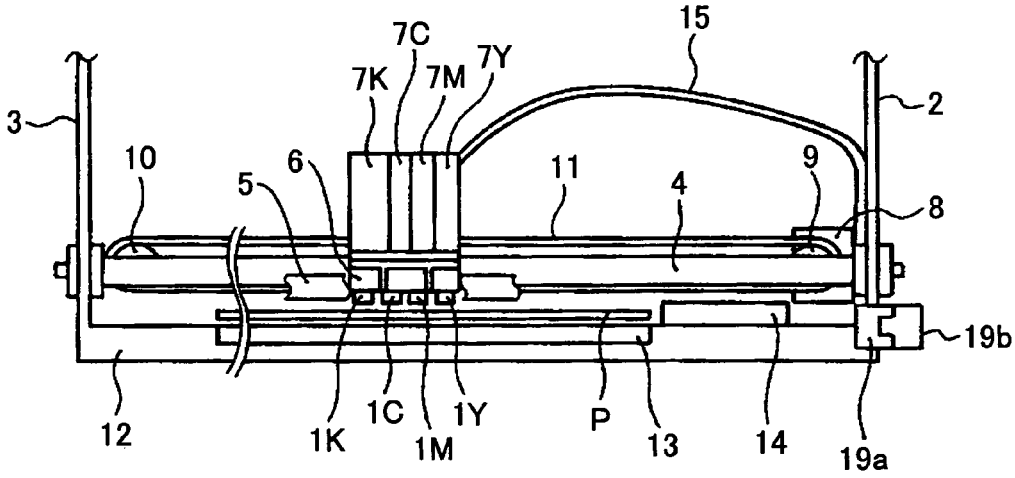
FIG. 2 is a side view showing a schematic structure of the vicinity of a printing mechanism of the printer.

FIG. 2 is a side view showing a schematic structure of the vicinity of a printing mechanism of the printer of this embodiment. In this printer, ink as an aqueous recording liquid is discharged from a recording head so that an image is recorded on a recording surface of a recording paper P as a recording medium.

More specifically, a printing mechanism of a printer of this embodiment has a structure where a main support guide rod 4 and a sub support guide rod 5 are provided in a substantially horizontal position between side plates 2 and 3. A carriage unit 6 is supported so as to be capable of sliding in a main scanning direction by the rods 4 and 5. The carriage unit 6 has four recording heads 1Y, 1M, 1C and 1K from which yellow (Y) ink, magenta (M) ink, cyan (C) ink, and black (K) ink are discharged. The recording heads 1Y, 1M, 1C and 1K are provided in the carriage unit 6 in a state where their discharging surfaces (nozzle surfaces) face straight down in FIG. 2. Furthermore, ink receiving parts 7Y, 7M, 7C and 7K are provided for respective colors at an upper side of the recording heads 1Y, 1M, 1C and 1K of the carriage unit 6 in FIG. 2.

The carriage unit 6 is connected to a timing belt 11 which is stretched between a driving pulley (driving timing pulley) 9 driven by a main scanning motor 8 and a sub pulley (idler pulley) 10. Under this structure, by controlling the main scanning motor 8, the carriage unit 6 having four recording heads 1Y, 1M, 1C and 1K can be moved to a desirable position in the main scanning direction. In addition, a printing guide plate 13 is provided at positions facing the recording heads 1Y, 1M, 1C and 1K at the time of image recording, on a bottom plate 12 to which the side plates 2 and 3 are connected. As described later, a recording paper P fed from a paper feeding tray is conveyed to a recording area (liquid drop discharge area) facing the recording heads 1Y, 1M, 1C and 1K. While a back surface side opposite to the recording surface is guided by the printing guide plate 13, an image recording process is performed by the recording head. Furthermore, when an image is not being recorded, the carriage unit 6 moves along the main scanning direction to a further outer side than the recording area so that the recording heads 1Y, 1M, 1C and 1K are capped by the head cap 14 provided there. In FIG. 2, the recording paper P is conveyed to the recording area, from a deep side to a front side orthogonal to the plane of the page surface of FIG. 2.

Figure 3:
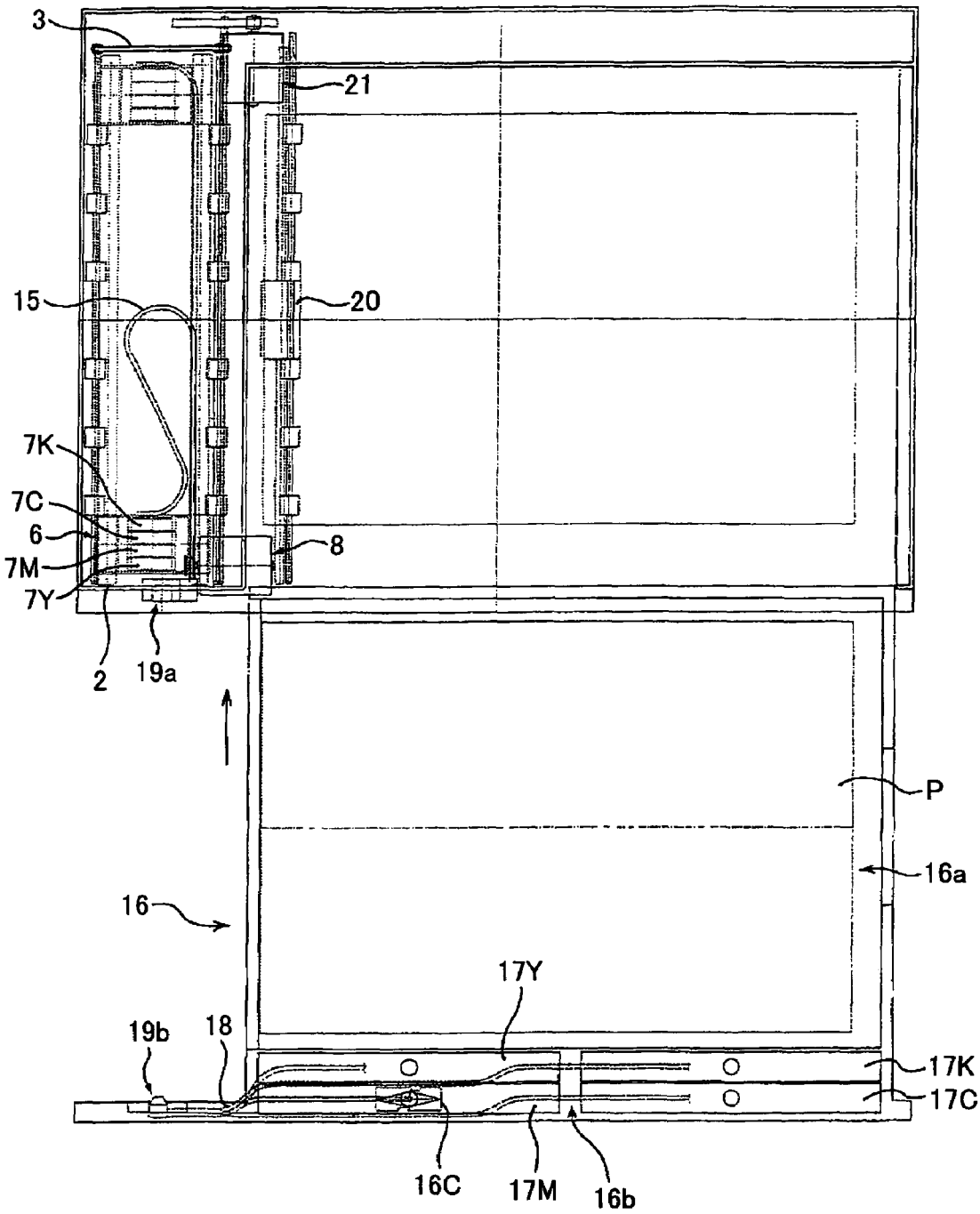
FIG. 3 is a top view showing a schematic structure of the whole of a printer.

FIG. 3 is a top view showing a schematic structure of the whole of the printer. FIG. 3 shows a state where the paper feeding tray 16 is pulled out from a printer main body.

Replenishment holes (not shown in FIG. 3) for supplying ink are formed in the ink receiving parts 7Y, 7M, 7C and 7K on the carriage unit 6. An end of a first replenishment tube 15 is connected to the replenishment hole. The other end of the first replenishment tube 15 is connected to a first connection part 19*a* provided on the side plate 2. A recording paper receiving part 16*a* and an ink cartridge holder 16*b* are provided in the paper feeding tray 16. Plural recording papers P are superposed on each other in the recording paper receiving part 16*a* so that short dimensions of the recording papers P are consistent with the main scanning direction. The ink cartridges 17Y, 17M, 17C and 17K are set in the ink cartridge holder 16*b*. Opening parts of the ink cartridges 17Y, 17M, 17C and 17K are detachably connected to an ink absorption nozzle 16*c* of the ink cartridge holder 16*b*. An end of a second replenishment tube 18 is connected to the ink absorption nozzle 16*c*. The other end of the second replenishment tube 18 is connected to a second connection part 19*b* provided on the side plate 16*c* of the paper feeding tray 16. The paper feeding tray 16 is received in an inside of the printer main part so that the second connection part 19*b* is connected to the first connection part 19*a* provided on the side plate 2 of the printer main body. Under this structure, the inks in the ink cartridges 17Y, 17M, 17C, and 17K are supplied to the ink receiving parts 7Y, 7M, 7C and 7K, respectively on the carriage unit 6, via the ink absorption nozzle 16*c*, the second replenishment tube 18, the second connection part 19*b*, the first connection part 19*a* and the first replenishment tube 15. Based on receipt of the paper feeding tray 16 by the inside part of the printer main body, the recording paper P provided in the recording paper receiving part 16*a* is positioned at a lower position of a feeding roller 20. A driving force is transmitted from a motor for paper-feeding (not shown in FIG. 3) to the feeding roller 20 via a clutch mechanism (not shown in FIG. 3). Therefore, by controlling the motor and the clutch mechanism, it is possible to control the timing of paper-feeding of the recording paper P.

Figure 1:
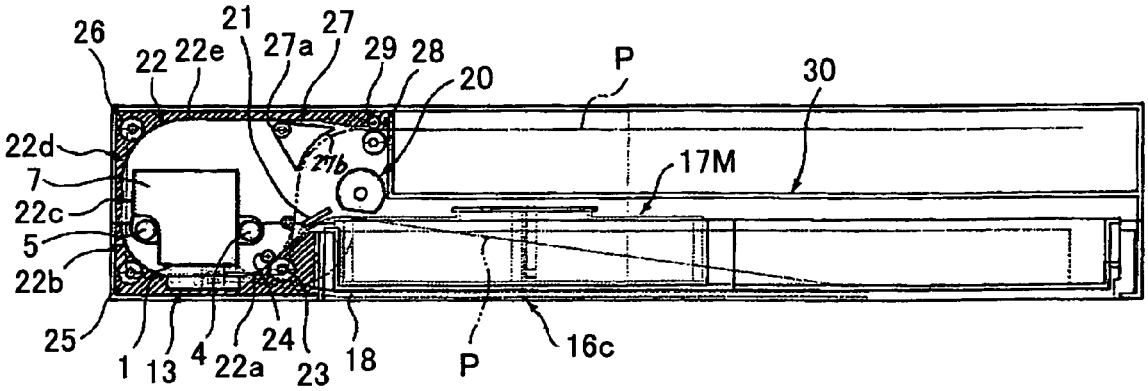
FIG. 1 is a front view showing a schematic structure of the whole of a printer of an embodiment of the present invention.

FIG. 1 is a front view showing a schematic structure of the whole of the printer seen from a direction of the side plate 2. Color differentiations Y, M, C, and K are omitted in the following explanation.

Based on input of a print order, the motor for paper-feeding is driven by a control part (not shown in FIG. 1) so that the roller 20 is rotated via the clutch mechanism. As a result of this, a recording paper P situated at the top of plural papers superposed in the recording paper receiving part 16*a* of the paper feeding tray 16 is fed in a longitudinal direction to the recording area side. After that, the transfer of the driving force from the motor for paper-feeding to the roller 20 is cut by the clutch mechanism. A head end of the fed recording paper P comes in contact with the guide plate 21 so as to move between a guide surface part 22*a* formed by the guide surface forming member 22 shown by cross-hatching in FIG. 1 and the guide plate 21 toward the recording area facing the recording head 1 and be put between the resist roller 23 and the back up roller 24. This resist roller 23 can be rotationally driven by the driving force from the motor for paper-feeding. The control part detects the head position of the recording paper P by a sensor or the like and then drives the resist roller 23 so that the recording paper P is sent to the recording area at a designated timing. Because of this, a conveying force is applied from the resist roller 23 to the recording paper P so that the recording paper P is conveyed to the recording area along a conveying path shown by the one-dotted line in FIG. 1.

The recording paper part sent by the resist roller 23 moves and arrives at the recording area while curving along a first curved surface 22*a* of the guide surface forming member 22. The curved part of the recording paper P is pushed to a side of the first curved surface 22*a* by a restoring force due to the stiffness of the recording paper P. Therefore, the recording paper P moves while being curved along the first curved surface 22*a*. While the recording paper P passes through the recording area, the liquid drop of the ink is discharged from the recording head 1 to the recording paper P so that the image is recorded. The recording paper part which passes through the recording area, that is, the recording paper part where the image is recorded by adhesion of the ink to the recording surface, is conveyed while being curved along the second curved surface 22*b* which curves to an upper part in FIG. 1. In this case, because of the restoring force of the recording paper P due to the stiffness of the recording paper P, the recording paper P moves while being curved along the second curved surface 22*b* in a state where the recording paper part is pushed to a side of the second curved surface 22*b*.

In a case where the recording paper P is conveyed in the curved state, as described above, the curved part of the recording paper P is pushed to the second curved surface 22*b* by the restoring force of the recording paper P due to the stiffness of the recording paper P, a friction force between the second curved surface 22*b* and the recording paper P is increased. As a result of this, a conveying load at this curved part becomes large. Therefore, in this embodiment, a first driving roller 25 as a surface moving member is provided at the guide surface forming member 22 so that a surface of the first driving roller 25 slightly projects from the second curved surface 22*b*. The first driving roller 25, as well as the resist roller 23, is rotationally driven by the driving force from the motor for paper feeding. Therefore, the external circumferential surface of the recording paper part which is curved along the second curved surface 22*b* comes in contact with the surface of the first driving roller 25, so that a conveying force is given from the first driving roller 25 to the external circumferential surface of the recording paper part which is curved along the second curved surface 22*b* by a friction force generated at the contact part.

At this time, the restoring force of the recording paper P due to the stiffness of the recording paper P makes the external circumferential surface of the recording paper push to the surface of the first driving roller 25 so as to increase the friction force working between them. Accordingly, in this embodiment, the restoring force of the recording paper P due to the stiffness of the recording paper P works for improving conveyance ability rather than increasing a conveyance load. Therefore, even if the back up roller is not separately provided to make the curved recording paper part push to the surface of the first driving roller 25, it is possible to obtain stable and sufficient conveyance ability.

In addition, the surface of the recording paper P where the surface of the first driving roller 25 comes in contact is not the recording surface where the image is recorded by the adhesion of the ink but a back surface opposite to the recording surface. Therefore, even if a slight slip is generated between the surface of the first driving roller 25 and the surface of the recording paper P, it is possible to prevent rubbing and disarranging the image on the recording surface.

If a back up roller which rotates as the recording paper P moves is provided so as to face the first driving roller 25, the friction force may the increased so that a more stable and sufficient conveyance ability may be obtained. Even if the back up roller comes in contact with the recording surface where the image is recorded, it may be difficult for the slip to occur and there may not be large image disarrangement. However, the recording surface where the back up roller comes in contact is in a state just after the ink is adhered. Therefore, the un-dried ink may adhere to the back up roller so that the image quality may be degraded. Furthermore, the ink adhered to the back up roller may adhere to the recording surface which comes later so that a ghost image or the like may be generated. Accordingly, it is preferable that such a back up roller not be provided.

The recording paper part passing through the second curved surface 22*b* where the first driving roller 25 is provided, is guided by a first straight-line surface 22*c* so as to arrive at a third curved surface 22*d*. The second driving roller 26 as the surface moving member is provided at the third curved surface 22*d* and therefore the same effect with the second curved surface 22*b* can be obtained. The recording paper part conveyed along the third curved surface 22*d* is then guided by a second straight-line surface 22*e* and passes through a position facing a movable guide member 27 so as to be pushed out between a discharge roller 28 and a back up roller 29. The discharge roller 28, as well as the resist roller 23, the first driving roller 25, and the second driving roller 26, is rotationally driven by the driving force from the motor for paper-discharging. The driving force is transferred from the motor for paper-discharging to the paper discharging roller 28 via a rotation mechanism (not shown) for changing the direction of the rotation. Therefore, the paper discharge roller 28 of this embodiment can be rotated in either direction by this mechanism under the control of the control part. Here, the rotational direction when the recording paper P conveyed from the side of the third curved surface 22 is discharged to the side of the paper discharge tray 30 is defined as a positive direction.

In this embodiment, the liquid drop discharge direction of the recording head 1 goes straight down in the vertical direction. The recording paper P passes through the recording area facing the recording head 1 in a state where the recording surface of the recording paper P faces up. Then, the recording paper P passes through the area right above in the vertical direction of the recording head 1, in a state where the recording paper P is conveyed in the curved state so that the recording surface faces straight down in the vertical direction. Then, the recording paper P is discharged to the paper discharge tray 30. Therefore, the recording papers P are stacked in order from the side of a tray bottom surface in the paper discharge tray 30 in a state where the recording surface where the image is recorded faces the side of the tray bottom surface. Therefore, it is possible to be consistent with an arranging order and a printing order of the recording medium where the image is recorded and thereby it is possible to improve convenience for the user. Furthermore, in this embodiment, the conveyance path length from the recording area to the paper discharge area is longer than in the conventional art. Hence, it is possible to secure time for sufficiently drying the ink before the recording paper P is discharged. Because of this, for example, even if the recording paper P is handled by the user immediately after being discharged, it is possible to prevent the image from being disarranged.

In addition, in this embodiment, the carriage unit 6 having the recording head 1 is arranged at an inside of the conveyance path (shown by the one-dotted line in FIG. 1) of the curved recording paper P. Thus, it is possible to make the size of the printer main body small by effectively using the dead space, namely the inside of the conveying path.

Furthermore, normally, if the ink is adhered, the ink liquid penetrates into the adhered surface so that the surface is expanded. As a result of this, the recording paper where the image is recorded may be warped so that the recording surface side where the ink is adhered is the external circumferential surface. However, in this embodiment, since the recording surface side where the ink is adhered is the internal circumferential surface when the recording paper P is conveyed in a curved state, such a warp can be prevented and therefore no warped recording paper P is discharged into the paper discharge tray 30.

In addition, if the ink is adhered to the recording area of the recording paper P, the stiffness of the recording paper P is weakened due to moisture of the ink. Because of this, in this embodiment, curvature radiuses of the second curved surface 22*b* and the third curved surface 22*d* formed by the guide surface forming member 22 are formed so as to be equal to or less than 35 mm. It is possible to increase the curvature of the recording paper P by making the curvature radius small. Hence, even in the recording paper P having a weak stiffness due to the moisture of the ink, it is possible to obtain sufficient restoring force. Because of this, it is possible to obtain a sufficient friction force between the recording paper P and the first and second driving rollers 25 and 26 and obtain stable conveyance ability.

In addition, by the printer of this embodiment, it is possible to perform printing for both surfaces, namely to record an image on both surfaces of the recording paper P. In a case of printing for both surfaces, based on an input of a print order of printing for both surfaces, an operation similar to printing for one surface is performed under the control by the control part so that the image is recorded on the recording surface of the recording paper P. In the case of printing for both surfaces, after the rear end of the recording paper P having the recording surface where the image is recorded passes a position facing the movable guide member 27, the movable guide member 27 rotates under the control of the control part in a state where the rotation shaft 27*a* is the center of the rotation. That is, the movable guide member 27 is separated from the second straight line surface 22*e* and rotates until it comes in contact with the second straight line surface 22*e*. Furthermore, after the rear end of the recording paper P passes the position facing the movable guide member 27, under the control of the control part, a discharge roller 28 which works as a switch back part stops for a time. Because of this, the rear end of the recording paper P is put between the discharge roller 28 and the back up roller 29. After the discharge roller 28 rotates until the movable guide member 27 comes in contact with the second straight line surface 22*e*, the paper discharge roller 28 rotates in reverse so that the recording paper P is conveyed to the side of the movable guide member 27. As a result of this, the recording paper P is conveyed in a state where the rear end side becomes the front end side. The front end of the conveyed recording paper P collides with the curve guide surface 27*a* of the movable guide member 27 and is conveyed along the conveyance path shown by the two-dotted line by the guide of the curved guide surface 27*a*. After that, the front end of the recording paper P collides with the first curve guide surface 22*a* of the guide surface forming member 22 and is conveyed by the guide of the first curved surface 22*a*. Thus, the recording paper P conveyed into the recording area is in a state where a back surface opposite to the recording surface where the image is recorded faces the recording head 1 and the image is recorded on the back surface. After that, in a way similar to the above-discussed way, the recording paper P is discharged to the paper discharge tray 30.

Thus, the printer in this embodiment has a structure where the recording paper part in a state where the recording surface of the recording paper P faces the lower part in a vertically lower direction passes through the upper part in the vertical direction of the recording head 1. Hence, printing on both surfaces printing can be easily realized by making the rotational direction of the paper discharge roller 28 changeable and providing a simple path switching part for switching the conveyance path such as the movable guide member 27. Furthermore, in this embodiment, since the paper discharge tray 30 is provided on the upper surface of the printer main body and there are no obstacles above this, it is possible to see from outside and easily take the recording paper P which is discharged to the paper discharge tray 30 and on which the image is recorded.

FIRST MODIFIED EXAMPLE

Next, a first modified example of a device layout of the printer of the above-mentioned printer is discussed.

Figure 4:
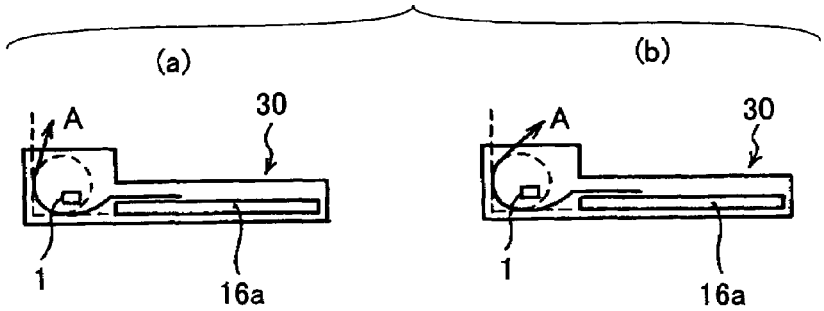
FIG. 4 is a view showing a schematic structure of a device layout of a first modified example of the present invention.

FIG. 4-(*a*) and FIG. 4-(*b*) are views showing a schematic structure of the device layout of the first modified example.

In the above-mentioned embodiment, the printing paper is curved and conveyed so that the conveyance direction of the recording paper part passing through the recording area is changed 180 degrees and then the recording paper is discharged. However, it is not always necessary to curve and convey the printing paper so that the conveyance direction of the recording paper part passing through the recording area is changed 180 degrees. That is, in a case where the recording paper is conveyed in the curved state until the recording surface where the liquid drop discharged from the recording head 1 faces a lower part in a vertically lower direction and then the recording paper is discharged, it is possible to be consistent with an arranging order and a printing order of the recording medium where the image is recorded. Therefore, as the first modified example shown in FIG. 4-(*a*) and FIG. 4-(*b*), even in a case where the recording paper is conveyed in the curved state so that the conveyance direction of the recording paper part passing through the recording area is changed more than 90 degrees as shown by arrow A in FIG. 4 and the recording surface becomes an internal circumferential surface, it is possible to be consistent with an arranging order and a printing order of the recording medium where the image is recorded. In this case, the recording paper part which is discharged outside is bent due to own weight by gravity so as to be eventually provided on the paper discharge tray 30.

SECOND MODIFIED EXAMPLE

Next, a second modified example of a device layout of the printer of the above-mentioned printer is discussed.

Figure 5:
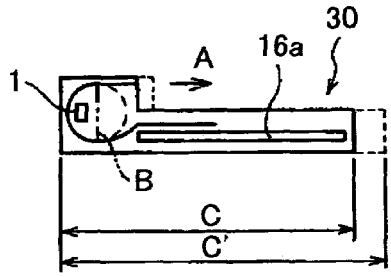
FIG. 5 is a view showing a schematic structure of a device layout of a second modified example of the present invention.

FIG. 5 is a view showing a schematic structure of the device layout of the second modified example.

In the above-mentioned embodiment, the liquid drop discharge direction of the recording head 1 goes straight down in the vertical direction. As long as the liquid drop is discharged in a horizontal direction or a vertically lower direction than the horizontal direction, the discharge speed of the ink is not reduced due to gravity. Therefore, as the second modified example shown in FIG. 5, even in a case where the recording head 1 is arranged so that the discharge direction of the liquid drop is a horizontal direction, it is possible to sufficiently adhere the liquid drop of the ink on the recording paper P at the discharge force of the known recording head 1. In a case where the drop discharge direction of the recording head 1 does not go straight down in the vertical direction but tilts to a vertically lower direction that the horizontal direction, the trajectory of the liquid drop of the discharged ink slightly bends in the gravity direction due to gravity. Hence, it is preferable to make settings taking into consideration this bending so as to obtain a high quality image.

In the modified second example, the recording head 1 is arranged so that at least one part of the recording head 1 is situated in an area surrounded by the curved part of the recording paper P. More specifically, this area is surrounded by an internal circumferential surface of a curved part of the recording paper P, an imaginary surface B formed by connecting front and rear ends in the conveyance direction of the curved part, and an imaginary surface (not shown in FIG. 5) formed by connecting sides of the recording paper in directions perpendicular to the conveyance direction of the curved part. Since generally this area may be a dead space, it is possible to make the printer main body small by providing the recording head 1 in this area. More specifically, as shown in FIG. 5, as compared with the printer in the above mentioned embodiment, it is possible to make the recording paper receiving part 16*a* of the paper discharge tray 16 close to the recording area side. As a result of this, a width C of the printer of the modified second example can be shorter than a width C' of the printer of the above-mentioned embodiment, so that the printer of the modified second example can be made small.

THIRD MODIFIED EXAMPLE

Next, a third modified example of a device layout of the printer of the above-mentioned printer is discussed.

Figure 6:
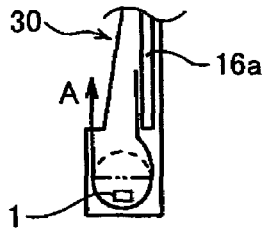
FIG. 6 is a view showing a schematic structure of a device layout of a third modified example of the present invention.

FIG. 6 is a view showing a schematic structure of the device layout of the third modified example.

In the above-mentioned embodiment, a printer (horizontal arrangement printer) expected to be arranged so that the surface of the recording paper P set in the paper discharge tray is substantially consistent with a horizontal surface is discussed. In the modified third example, a printer (vertical arrangement printer) expected to be arranged so that the surface of the recording paper P set in the paper discharge tray is substantially consistent with a vertical surface is used. That is, the printer used in the third modified example has the same structure as the printer used in the second modified example but is vertically arranged. However, the discharge direction of the liquid drop is a horizontal direction in the second modified example while the discharge direction of the liquid drop goes straight down in the vertical direction in the third modified example. In addition, in the third modified example, as shown in FIG. 6, the paper discharge direction A tilts to the side of paper discharge tray 30 from the straight up vertical direction. The paper discharge tray 30 is formed so as to be tilted from the paper discharge roller 28. Under this structure, the recording paper P discharged from the paper discharge roller 28 falls down to the side of the paper discharge tray 30 due to own weight based on gravity so as to be stacked on the paper discharge tray 30.

The area of a surface for the vertically arranged printer of the third modified example can be much smaller than the horizontally arranged printer of the above-discussed embodiment. Hence, even if the space for arranging the printer is small, it is possible to provide the printer.

FOURTH MODIFIED EXAMPLE

Next, a fourth modified example of a device layout of the printer of the above-mentioned printer is discussed.

A printer of the fourth modified example is expected to be used in both horizontal and vertical arrangements. However, in a case where the horizontal arrangement printer is simply arranged vertically or vertical arrangement printer is simply arranged horizontally, the discharge direction of the liquid drop against the gravity direction is changed by the arrangement. As a result of this, since the gravity direction applied to the ink discharged from the recording head 1 is changed, it is difficult to obtain an image quality the same as the image quality prior to change of the arrangement. On the other hand, although it is possible to record the image even if the discharge direction of the liquid drop does not go straight down in the vertical direction but tilts in a vertically lower direction that the horizontal direction as shown in the second modified example, it is not easy to obtain a high quality image by settings based on the consideration of the bending of the liquid drop trajectory due to gravity. Therefore, it is desirable to form a structure where the discharge direction of the liquid drop always goes straight down in the vertical direction at the time of the image recording regardless of horizontal or vertical arrangement of the printer.

Figure 7:
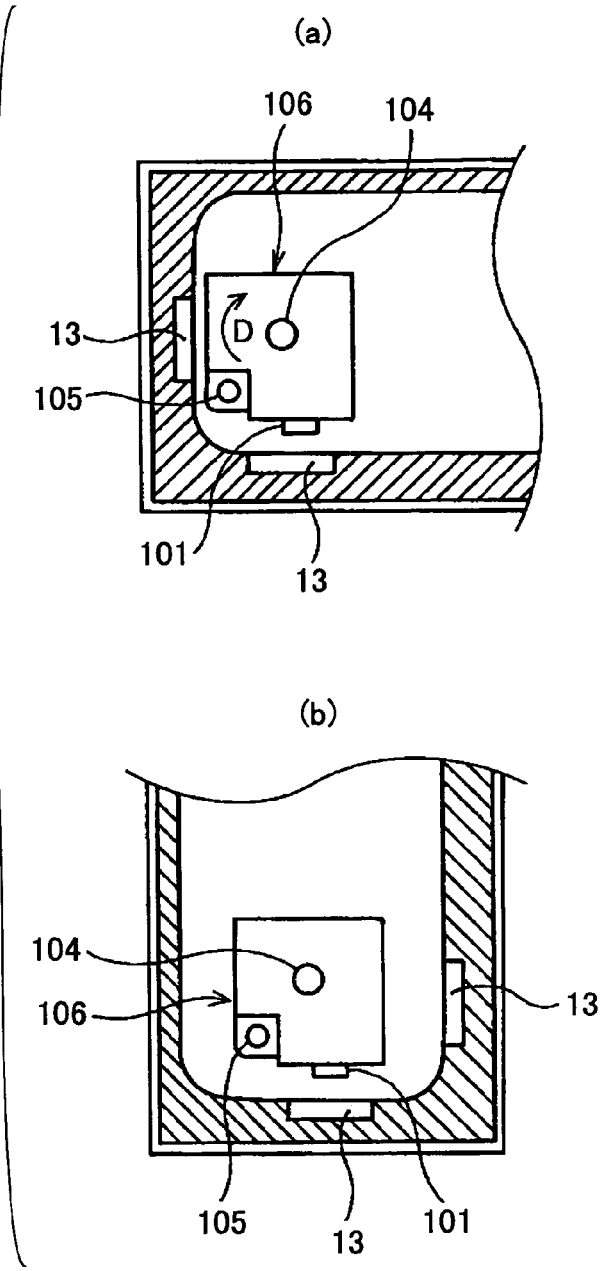
FIG. 7 is a schematic structure view of a head driving mechanism for moving a recording head of the printer of a fourth modified example, seen from a printer front surface side.
Figure 8:
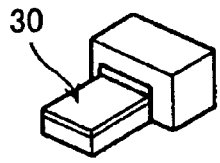
FIG. 8 is a view for explaining an example of a structure where there is no cover part at an upper part of the paper discharging tray.

FIG. 7 (FIG. 7-(*a*) and FIG. 7-(*b*)) is a schematic structure view of a head driving mechanism for moving a recording head of the printer of a fourth modified example, seen from the printer front surface side.

In a case where the printer of the fourth modified example is horizontally arranged as shown in FIG. 7-(*a*), a carriage unit 106 is positioned so that the discharge direction of the liquid drop of the recording head 101 faces straight down in the vertical direction. When the printer horizontally arranged is arranged vertically as shown in FIG. 7-(*b*), the sub support guide rod 105 rotates in a direction shown by arrow D in FIG. 7-(*a*) in a state where a main support guide rod 104 is the center of the rotation. The carriage unit 106 is positioned so that the discharge direction of the liquid drop of the recording head 101 faces straight down in the vertical direction. For example, a mechanism wherein handle means such as a lever is provided on the side surface of the printer and the sub support guide rod 105 is rotated by the user operating the handle means, can be applied as a head driving mechanism for rotating the sub support guide rod 105 and moving the recording head 101. In addition, for example, the following structure may be applied. Namely, the user indicates whether the printer is vertically or horizontally arranged by operation means such as an operations panel of the printer so that the contents of the indication are sent to the control part. The rotation motor of the head driving mechanism is controlled by the control part. Based on the rotation of the motor, the sub support guide rod 105 is rotated. Alternatively, for example, the following structure also may be applied. Namely, detector means such as a gravity sensor for detecting whether the printer is vertically or horizontally arranged is provided. As for making the gravity direction consistent with the discharge direction of the liquid drop of the recording head 101 corresponding to the gravity direction of the recording head 101, the rotation motor of the head driving mechanism is controlled by the control part and the sub support guide rod 105 is rotated based on the rotation of the motor. In this case, since a user operation is not necessary, it is possible to improve convenience for the user.

Thus, the printer as the inkjet recording device of this embodiment has the recording head 1 configured to discharge the liquid drop of the ink as a recording liquid in the horizontal direction or to the lower part in a vertically lower direction than the horizontal direction. In addition, the printer has a conveying device having a roller group such as the resist roller 23, the first driving roller 25, and the second driving roller 26, and the driving motors; and the guide surface forming member 22 as a conveying part configured to convey the recording paper P so that the recording surface faces the recording head 1 when the recording paper P passes the recording area as a liquid drop discharge area of the recording head 1. In addition, the recording paper P is discharged, after the recording paper is conveyed in a curved state so that the recording surface where the liquid drop discharged from the recording head 1 is adhered faces the lower part in the vertical direction, by the conveying device. Furthermore, the conveying device includes the first driving roller 25 and the second driving roller 23 as a surface moving member configured to make a moving surface of the surface moving member come in contact with an external circumferential surface of a curved part of the recording paper P so as to give a conveying force to the recording paper P by a friction force. Under this structure, while the recording head 1 configured to discharge the liquid drop in the horizontal direction or to the lower part in a vertically lower direction than the horizontal direction, it is possible to be consistent with the arranging order and the printing order of the recording medium where the image is recorded. Hence, it is possible to easily realize the present invention. In addition, it is possible to obtain stable conveyance ability without degrading image quality.

Furthermore, in the printer of this embodiment, a recording paper part in a state where the recording surface of the recording paper faces the lower part in the vertical direction passes through an upper part in the vertical direction of the recording head 1, conveyed by the conveying part. Under this structure, as described above, since the recording head 1 is arranged inside of the conveyance path of the curved recording paper P, it is possible to make the size of the printer main body small by effectively using the dead space, namely the inside of the conveying path. In addition, the printer of this embodiment has a switch back device formed by the movable guide member 27, the paper discharge roller 28, and driving sources for driving them, as a switch back part configured to change the direction of the recording paper P which passes through the upper part in the vertical direction of the recording head 1 so as to deliver the recording paper P to the conveying device. The conveying device conveys the recording paper P so that a back surface opposite to the recording surface of the recording paper P delivered by the switch back part faces the recording head 1 when the recording paper P passes through the recording area. Thus, it is possible to easily realize printing on both surfaces by effectively using a mechanism whereby the recording paper P is conveyed in the curved state and turned upside down.

As discussed in the second modified example, the recording head 1 is arranged so that at least one part of the recording head 1 is situated in an area surrounded by the curved recording paper part. Because of this, it is possible to make the size of the printer small.

As discussed in the fourth modified example, by providing a head driving mechanism as a recording head moving part configured to move the recording head 1 so that the discharging direction of a liquid drop of the recording head 1 is changed, it is possible to discharge the ink in the liquid drop discharge direction proper for the arrangement of the printer and to record the image. Therefore, it is possible to provide a printer which can be expected to perform in plural arrangements of the printer without changing the image quality regardless of change of the arrangement.

Particularly, as discussed in the fourth modified example, in a case where a control part configured to control the head driving mechanism so that a relationship between the direction of gravity applied to the recording head 1 and the discharging direction of the liquid drop of the recording head 1 is kept constant, corresponding to the direction of gravity, is provided, the recording head 1 can be automatically moved by only changing the arrangement of the printer so that the convenience for the user can be improved.

Furthermore, in this embodiment, since the driving rollers 25 and 26 are used for giving the conveyance force to the curved part of the recording paper P, it is possible to give the conveyance force by a simple structure and therefore it is possible to reduce the cost.

In addition, in this embodiment, since at least one part of the curved part of the recording paper P has a curvature radius equal to or smaller than 35 mm, it is possible to generate a sufficient restoring force of the recording paper P whose stiffness becomes weak due to the moisture of the ink. As a result of this, it is possible to sufficiently obtain the friction force between the recording paper P and the first and second driving rollers 25 and 26 and improve the stable conveyance ability.

In the above-discussed embodiment and modified examples, considering stableness of conveyance of the recording paper, the recording paper P is conveyed in a longitudinal direction. However, the recording paper P can be conveyed in the short side direction. In this case, it is possible to reduce the printing time.

In this embodiment, when the paper feeding tray 16 is set in the printer main body, the whole of the paper feeding tray 16 is received in the printer main body. That is, an end part of the paper feeding tray 16 does not project from the inside of the printer main body to the outside. Because of this, the following advantages can be obtained. That is, the recording paper P in the paper feeding tray 16 is protected against dust, moisture, bending, or the like. It is possible to make a packing state or using state small. It is possible to avoid having to provide a lid for the projection part necessary when a part of the paper feeding tray is projected and it is therefore not necessary to open and close the lid. It is possible to design the printer with a simple and beautiful outside appearance.

In addition, in this embodiment, when the paper feeding tray 16 is attached to or detached from the printer main body, it is not necessary to move the paper discharge tray 30. Therefore, in a state where the recording paper P, while the image is being recorded, remains to be discharged to the paper discharging tray 30, it is possible to set a new recording paper P in the paper feeding tray 16.

Furthermore, in this embodiment, since there are no obstacles such a structural body of the printer above the paper discharge tray 30, it is possible to see from outside and easily take the recording paper P which is discharged to the paper discharge tray 30 and on which the image is recorded. This advantage can be obtained from a structure shown in FIG. 8.

Figure 9:
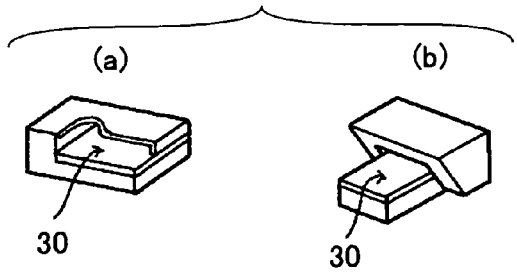
FIG. 9 is a view for explaining an example of a structure of a body inside paper discharging structure wherein a structure body of the printer is provided at the upper part of the paper discharging tray.

On the other hand, if the structural body of the printer is arranged above the paper discharge tray 30 as shown in FIG. 9-(*a*) and FIG. 9-(*b*), the above-discussed advantage may not be obtained. However, in this case, it is possible to effectively use the space above the paper discharge tray 30 and therefore it is possible to make the size of the printer body small.

Particularly, by using an inside body paper discharge structure, namely a structure where the structural body of the printer is arranged above the paper discharge tray 30 and is supported by an end part of the paper discharge tray at a side facing the paper discharge opening, it is possible to improve a load-resisting ability. Hence, even if a heavy thing is put on the upper surface of the printer, it is possible to stably support this structure body.

Figure 10:
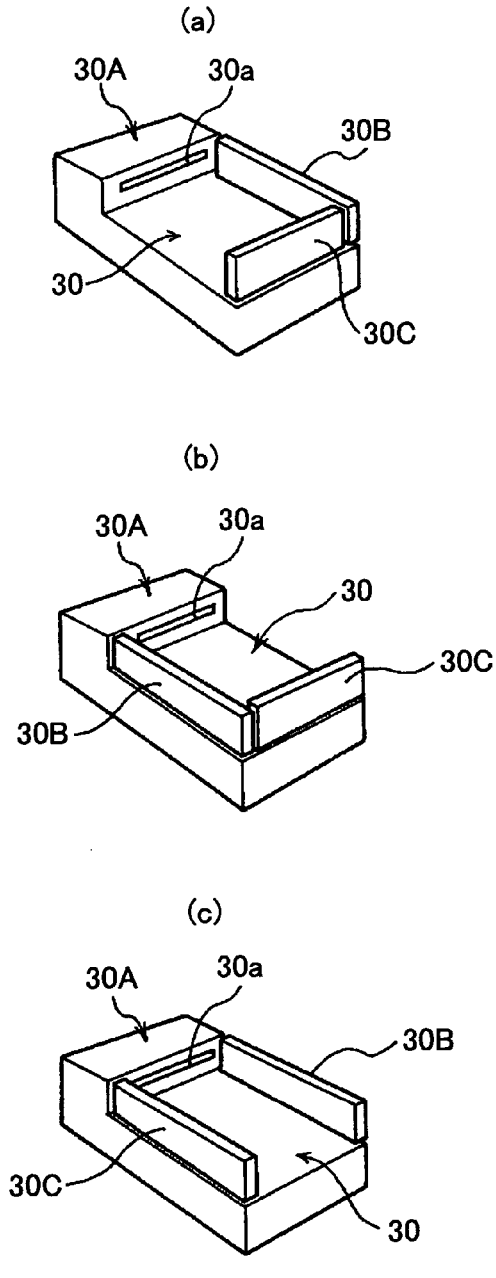
FIG. 10 is a view for explaining an example wherein the structure body of the printer is supported by three supporting bodies at the upper part of the paper discharging tray.

Furthermore, from the perspective of improvement of the load-resisting ability, as shown in FIG. 10-(*a*) through FIG. 10-(*c*), it is desirable that the structural body of the printer arranged above the paper discharge tray 30 be supported by support bodies 30A, 30B and 30C provided on three surfaces including a surface where a paper discharge opening 30*a* is provided among four surfaces surrounding the paper discharge tray 30. In FIG. 10, the structural body of the printer arranged above the paper discharge tray 30 is not shown.

In a case where the support bodies are also used for stopping paper discharge of the recording paper P discharged from the paper discharge opening, it is not necessary to separately provide a part for stopping paper discharging on the paper discharge tray 30. Under such an inside body paper discharge structure, in a case where an arrangement surface of the paper discharge tray 30 is made substantially horizontal, it is not necessary to tilt the surface of the paper discharge tray 30 so that the height of the printer main body can be shortened.

Figure 11:
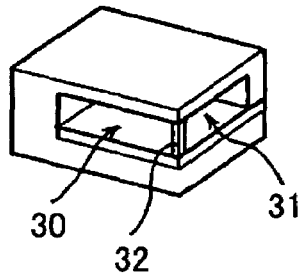
FIG. 11 is a view for explaining another example of the body inside paper discharging structure.

Under such an inside body paper discharge structure, as shown in FIG. 11, it is possible to make at least one notch of a side surface part and a back surface part excluding a surface where the paper discharge opening is formed in a paper discharge space on the paper discharge tray 30 seen from a printer front surface and form a connection part 31 for connecting the paper discharge space and the outside. In this case, since neighboring two surface parts are connected to each other and a pole 32 exists, it is possible to support the structural body of the printer arranged above the paper discharge tray 30 by the pole 32. Accordingly, even if a heavy thing is put on the upper surface of the printer, it is possible to stably support the structural body. In addition, as compared with a structure where only the front surface part of the paper discharge space is connected to the outside, it is possible to see from outside and easily take out the recording paper P which is discharged to the paper discharge tray 30.

Figure 12:
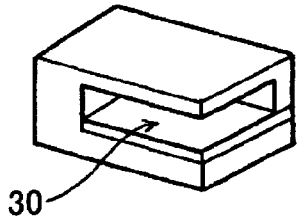
FIG. 12 is a view for explaining a further other example of the body inside paper discharging structure.

Furthermore, as shown in FIG. 12, the structural body of the printer arranged above the paper discharge tray 30 may be supported by a surface part where the paper discharge opening is formed and a back surface part in a state seen the paper discharge surface seen from the front surface of the printer. In this case, it is possible to obtain sufficient resisting-load ability. In this case, since the above-mentioned pole is not provided, it is possible to see from outside and take out the recording paper P which is discharged to the paper discharge tray 30, more easily. In addition, in this case, a relay mechanism to a following process unit can be easily provided.

In this embodiment, it is not necessary to provide fixing means because the printer is an inkjet type recording device. Therefore, as compared with an electronic picture type image forming device having a thermal fixing means, it is possible to prevent the temperature in the device from increasing. Therefore, it is not necessary to provide an arrangement space for an aeration duct or a ventilation fan for heat transfer, and therefore it is possible to prevent the device having the body inside paper discharge structure from having to be made large.

The operations panel as operation means operated by the user may be arranged at a place outside of the recording paper arrangement area on the paper discharge tray 30. In this case, even if the operations panel is provided on the paper discharge tray 30, it is possible to operate the operation panel without interfering with the discharged recording paper P. Particularly, in the case of the above-discussed body inside paper discharge structure, even if a thing is put on the upper surface of the printer main body, it is possible to operate the operations panel without interfering with the thing. On this point, it is more convenient than a case where the operations panel is provided on the upper surface of the printer.

Figure 13:
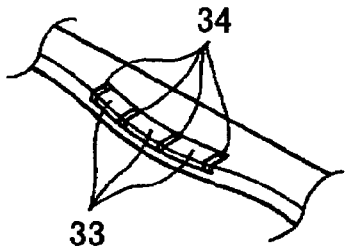
FIG. 13 is a perspective view showing an example of an operations panel of the printer.

The structure shown in FIG. 13 is used for the operations panel. That is, an operations panel having a structure where operations buttons 33 and indication lamps 34 are mutually arranged in one line is used. The operations button 33 is used for inputting contents of an instruction of the user. The indication lamps 34 are used for signaling information about the remaining amount of the ink, for example. Under this structure, as compared with a conventional device having a structure where a line of the operations buttons and a line of the indication lamps are arranged in parallel so as to form two lines, it is possible to make the depth of the printer main body small and obtain a simple and beautiful outside appearance.

Furthermore, in this embodiment, the paper feeding tray 16 is pulled out to a front surface side of the printer body. The recording paper P is received in the recording paper receiving part 16*a* of the paper feeding tray 16 so that the longitudinal direction of the recording paper P is perpendicular to the direction in which the paper feeding tray 16 is pulled out. Therefore, it is possible to make the depth of the printer main body small, as compared with a case where the recording paper P is received in the recording paper receiving part 16*a* of the paper feeding tray 16 so that the longitudinal direction of the recording paper P is consistent with the direction in which the paper feeding tray 16 is pulled out. In addition, when the recording paper P is supplied to the recording paper receiving part 16*a*, it is possible to reduce the pulling amount of the paper feeding tray 16. Because of this, it is possible to reduce the workload for supplying the recording paper P.

Furthermore, in the conventional inkjet printer, in order to prevent dust from invading the inside of the printer or making arrangement space at the time when the printer is not used to be small, it is necessary to make preparations before printing, such as assembling or pulling out the paper feeding tray or the paper discharge tray. On the other hand, in the printer of this embodiment, the recording paper P is conveyed in the curved state and the recording head 1 is arranged at the inside of the conveyance path. Therefore, without making the size of the printer large, it is possible to provide the paper feeding tray 16 and the paper discharge tray 30 having the same measurements in a using state as in a not-using state, to the printer main body. As a result of this, the preparations necessary for the conventional printer are not necessary so that it is possible to further improve the convenience for the user.

The present invention is not limited to the above-discussed embodiments, but variations and modifications may be made without departing from the scope of the present invention.

This patent application is based on Japanese Priority Patent Application No. 2004-32974 filed on Feb. 10, 2004, the entire contents of which are hereby incorporated by reference.

What is claimed is:

1. An inkjet recording device, comprising:

a recording head configured to discharge a liquid drop of recording liquid in a horizontal direction or in a downward direction;

a conveying part including a curved recording medium part, and configured to convey a recording medium so that a recording surface faces the recording head when the recording medium passes a liquid drop discharge area of the recording head; and a recording medium accommodating part configured to accommodate the recording medium to be supplied to the recording head;

wherein the recording medium is discharged, after the recording medium is conveyed in a curved state so that the recording surface where the liquid drop discharged from the recording head is adhered faces in a downward direction, by the conveying part, wherein the recording head is arranged so that at least a part of the recording head is situated in an area surrounded by the curved recording medium part, and wherein the curved recording medium part of the conveying part includes a first curved surface, to which the recording medium is pushed by a restoring force due to the stiffness of the recording medium so that the recording medium moves from the recording medium accommodating part to the recording head while being curved along the first curved surface.

2. The inkjet recording device as claimed in claim 1, wherein the recording medium in a state where the recording surface of the recording medium faces the downward direction is passed through an upper part in an upward direction from the recording head, by the conveying part.

3. The inkjet recording device as claimed in claim 2, further comprising:

a switch back part configured to change a direction of the recording medium which passes through the upper part in the upward direction from the recording head so as to deliver the recording medium to the conveying part, wherein the conveying part conveys the recording medium so that a back surface opposite to the recording surface of the recording medium delivered by the switch back part faces the recording head when the recording medium passes through the liquid drop discharge area.

4. The inkjet recording device as claimed in claim 1, further comprising:

a recording head moving part configured to move the recording head so that the discharging direction of the liquid drop of the recording head is changed.

5. The inkjet recording device as claimed in claim 4, further comprising:

a control part configured to control the recording head moving part so that a relationship between the direction of gravity applied to the recording head and the discharging direction of the liquid drop of the recording head is kept constant, corresponding to the direction of gravity.

6. The inkjet recording device as claimed in claim 1, wherein a driving roller is used as the surface moving member.

7. The inkjet recording device as claimed in claim 1, wherein at least one part of the curved part of the recording medium has a curvature radius equal to or smaller than 35 mm, formed by the conveying part.

8. An inkjet recording device, comprising:

a recording head configured to discharge a liquid drop of recording liquid in a horizontal direction or in a downward direction;

means for conveying a recording medium so that a recording surface faces the recording head when the recording medium passes a liquid drop discharge area of the recording head, and including a curved recording medium part; and a recording medium accommodating part configured to accommodate the recording medium to be supplied to the recording head;

wherein the recording medium is discharged, after the recording medium is conveyed in a curved state so that the recording surface where the liquid drop discharged from the recording head is adhered faces in a downward direction by the means for conveying, wherein the recording head is arranged so that at least a part of the recording head is situated in an area surrounded by the curved recording medium part, and wherein the means for conveying includes a first curved surface, to which the recording medium is pushed by a restoring force due to the stiffness of the recording medium so that the recording medium moves from the recording medium accommodating part to the recording head while being curved along the first curved surface.

9. The inkjet recording device as claimed in claim 8, wherein the recording medium in a state where the recording surface of the recording medium faces the downward direction is passed through an upper part in an upward direction from the recording head, by the means for conveying.

10. The inkjet recording device as claimed in claim 9, further comprising:

means for changing a direction of the recording medium which passes through the upper part in the upward direction from the recording head so as to deliver the recording medium to the means for conveying;

wherein the means for conveying conveys the recording medium so that a back surface opposite to the recording surface of the recording medium delivered by the means for changing the direction faces the recording head when the recording medium passes through the liquid drop discharge area.

11. The inkjet recording device as claimed in claim 8, further composing:

means for moving the recording head so that the discharging direction of the liquid drop of the recording head is changed.

12. The inkjet recording device as claimed in claim 11, further comprising:

means for controlling the means for moving the recording head, so that a relationship between the direction of gravity applied to the recording head and the discharging direction of the liquid drop of the recording head is kept constant, corresponding to the direction of gravity.

13. The irikjet recording device as claimed in claim 8, wherein a driving roller is used as the surface moving means.

14. The inkjet recording device as claimed in claim 8, wherein at least one part of the curved part of the recording medium has a curvature radius equal to or smaller than 35 mm, formed by the means for conveying.

* * * * *